US009200430B2

(12) United States Patent
Kawasaki et al.

(10) Patent No.: US 9,200,430 B2
(45) Date of Patent: Dec. 1, 2015

(54) CONTROL SYSTEM FOR HYBRID CONSTRUCTION MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 569 days.

(21) Appl. No.: 13/580,148

(22) PCT Filed: Feb. 23, 2011

(86) PCT No.: PCT/JP2011/054029

§ 371 (c)(1), (2), (4) Date: Aug. 20, 2012

(87) PCT Pub. No.: WO2011/118322

PCT Pub. Date: Sep. 29, 2011

(65) Prior Publication Data

US 2012/0312006 A1 Dec. 13, 2012

(30) Foreign Application Priority Data

Mar. 26, 2010 (JP) ..... 2010-72561

(51) Int. Cl.
*E02F 9/22* (2006.01)
*E02F 9/20* (2006.01)

(52) U.S. Cl.
CPC ..... *E02F 9/2075* (2013.01); *E02F 9/2079* (2013.01); *E02F 9/2217* (2013.01); *E02F 9/2235* (2013.01); *E02F 9/2242* (2013.01); *E02F 9/2282* (2013.01); *E02F 9/2285* (2013.01); *E02F 9/2292* (2013.01); *E02F 9/2296* (2013.01)

(58) Field of Classification Search
None
See application file for complete search history.

(56) References Cited

U.S. PATENT DOCUMENTS

| | | | | |
|---|---|---|---|---|
| 5,421,155 | A * | 6/1995 | Hirata et al. | 60/426 |
| 7,562,472 | B2 * | 7/2009 | Tozawa et al. | 37/348 |
| 7,596,893 | B2 * | 10/2009 | Tozawa et al. | 37/348 |
| 2004/0035103 | A1 * | 2/2004 | Nagura et al. | 60/414 |
| 2005/0036894 | A1 * | 2/2005 | Oguri | 417/212 |
| 2009/0036264 | A1 | 2/2009 | Tozawa et al. | |
| 2009/0288408 | A1 | 11/2009 | Tozawa et al. | |

FOREIGN PATENT DOCUMENTS

| | | | |
|---|---|---|---|
| JP | 2006-336845 | A | 12/2006 |
| WO | WO-2006-132009 | A1 | 12/2006 |
| WO | WO-2006-132010 | A1 | 12/2006 |

* cited by examiner

*Primary Examiner* — Nathaniel Wiehe
*Assistant Examiner* — Dustin T Nguyen
(74) *Attorney, Agent, or Firm* — Rabin & Berdo, P.C.

(57) ABSTRACT

A control system for hybrid construction machine includes an engine, a main pump to be driven by the engine, a rotary shaft linking an assist pump, a regenerative hydraulic motor and a motor generator, and a clutch for linking the engine and the rotary shaft.

4 Claims, 4 Drawing Sheets

CONTROL SYSTEM FOR HYBRID CONSTRUCTION MACHINE

TECHNICAL FIELD

The present invention relates to a control system for hybrid construction machine in which a generator is rotated by an output of an engine or a regenerative hydraulic motor and an assist pump is driven by a drive force of the generator.

BACKGROUND ART

JP2006-336845A discloses a hybrid construction machine in which an engine and a rotary shaft of a main pump are linked via a clutch and a rotational force of the rotary shaft is transmitted to a motor generator via a power transmission device.

The motor generator is connected to a regenerative hydraulic motor in a system different from the engine via a clutch. Accordingly, the motor generator can fulfill a power generation function utilizing either an output of the engine or an output of the regenerative hydraulic motor.

SUMMARY OF INVENTION

Since the clutches are separately provided in an engine system and a regenerative hydraulic motor system in the conventional control system, an apparatus is inevitably enlarged.

The present invention aims to provide an apparatus which is reduced in size by making it sufficient to provide one clutch and can drive an assist pump by a drive force of a regenerative hydraulic motor and that of a motor generator.

One aspect of the present invention is directed to a control system for hybrid construction machine, comprising an engine, a main pump to be driven by the engine, a rotary shaft coupled to an assist pump, a regenerative hydraulic motor and a motor generator, and a clutch for linking the engine and the rotary shaft.

According to the above aspect, the motor generator, the assist pump and the regenerative hydraulic motor are respectively coupled via the rotary shaft, the rotary shaft is linked to the clutch, and this clutch is linked to the engine that drives the main pump. Thus, one clutch suffices and an apparatus can be reduced in size. Further, the motor generator, the assist pump and the regenerative hydraulic motor can be assembled in a compact manner. Furthermore, since a drive force of the engine can be directly transmitted to the motor generator via the clutch, a power transmission device is not necessary unlike before and power transmission efficiency improves and power generation efficiency improves.

Embodiments of the present invention and advantages thereof are described in detail below with reference to the accompanying drawings.

EMBODIMENTS OF INVENTION

A first embodiment is described.

Figure 1:
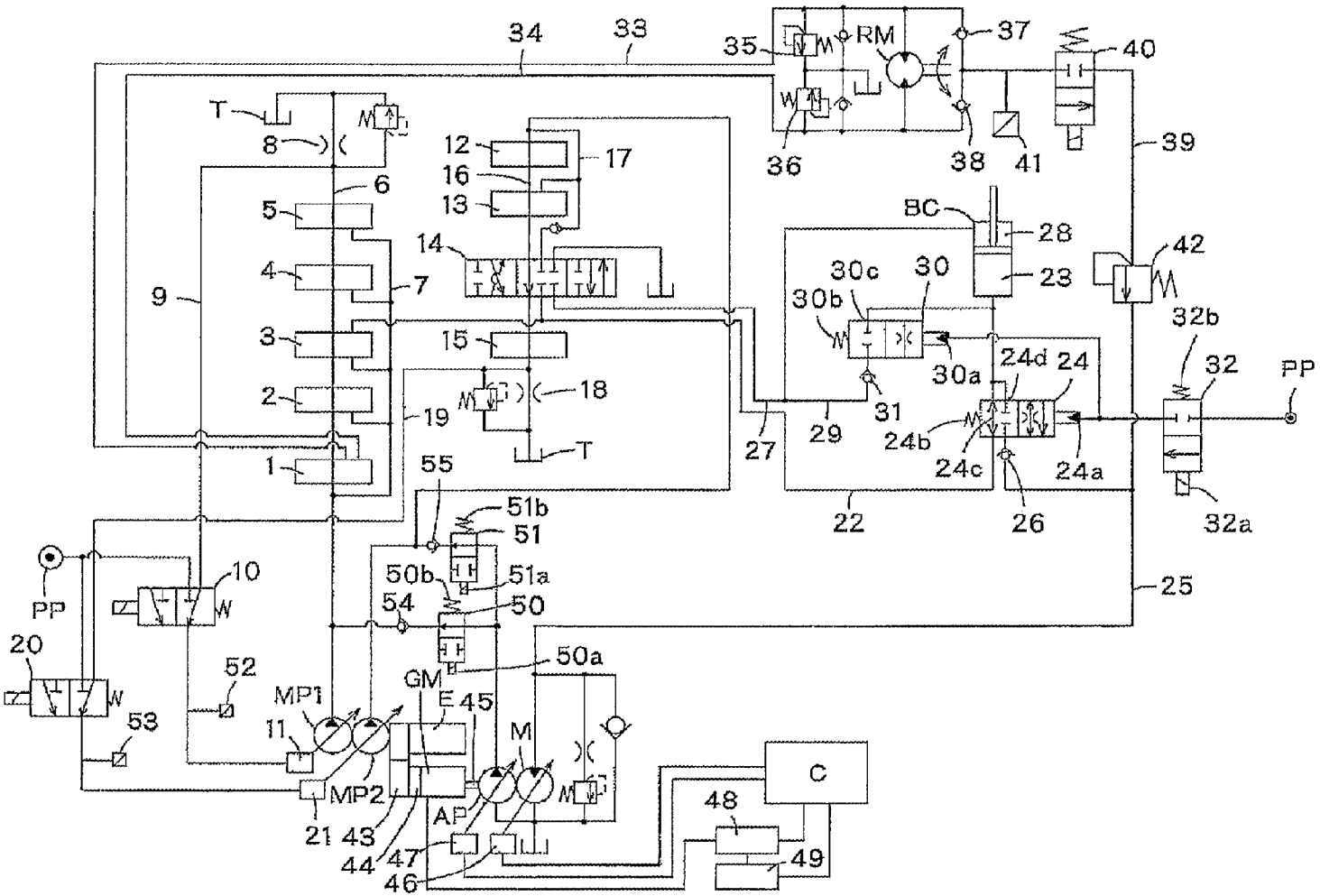
FIG. 1 is a circuit diagram of a control system for hybrid construction machine according to a first embodiment of the present invention.

The first embodiment shown in FIG. 1 includes first and second main pumps MP1, MP2 which are variable-displacement pumps, the first main pump MP1 is connected to a first circuit system, and the second main pump MP2 is connected to a second circuit system.

To the first circuit system connected to the first main pump MP1 are connected an operation valve 1 for controlling a rotation motor, an operation valve 2 for controlling an arm cylinder, an operation valve 3 for boom second speed for controlling a boom cylinder BC, an operation valve 4 for controlling an auxiliary attachment and an operation valve 5 for controlling a left travel motor in this order from an upstream side of the first circuit system.

Each operation valve 1 to 5 is connected to the first main pump MP1 via a neutral flow path 6 and a parallel passage 7.

A throttle 8 for pilot pressure control for generating a pilot pressure is provided downstream of the operation valve 5 for the left travel motor in the neutral flow path 6. The throttle 8 generates a high pilot pressure at an upstream side if a flow rate through the throttle 8 is high while generating a low pilot pressure if the flow rate is low.

Further, the neutral flow path 6 introduces all or a part of oil supplied from the first main pump MP1 to the first circuit system to a tank T via the throttle 8 when all the operation valves 1 to 5 are at or near a neutral position. In this case, a high pilot pressure is generated since the flow rate through the throttle 8 is high.

On the other hand, if the operation valves 1 to 5 are switched in a full-stroke state, the neutral flow path 6 is closed and a fluid does not flow any longer. Accordingly, the flow rate through the throttle 8 becomes zero, wherefore the pilot pressure is kept at zero.

Depending on the operating amounts of the operation valves 1 to 5, a part of pump-discharged oil is introduced to actuators and part thereof is introduced to the tank T from the neutral flow path 6. Thus, the throttle 8 generates a pilot pressure corresponding to the flow rate in the neutral flow path 6. In other words, the throttle 8 generates the pilot pressure corresponding to the operating amounts of the operation valves 1 to 5.

Further, a pilot flow path 9 is connected between the operation valve 5 and the throttle 8 in the neutral flow path 6. The pilot flow path 9 is connected to a regulator 11 for controlling a tilting angle of the first main pump MP1 via an electromagnetic switching valve 10.

The regulator 11 controls the tilting angle of the first main pump MP1 in inverse proportion to a pilot pressure in the pilot flow path 9 to control a displacement amount per rotation of the first main pump MP1. If there is no more flow in the neutral flow path 6 and the pilot pressure is zeroed by setting the operation valves 1 to 5 in the full-stroke state, the tilting angle of the first main pump MP1 is maximized to maximize the displacement amount per rotation of the first main pump MP1.

Further, the electromagnetic switching valve 10 is connected to a pilot hydraulic pressure source PP. When the electromagnetic switching valve 10 is at a normal control position which is a shown normal position, the regulator 11 communicates with the pilot flow path 9. When the electromagnetic switching valve 10 is switched to a switch position by exciting a solenoid thereof, the regulator 11 communicates with the pilot hydraulic pressure source PP. The solenoid of the electromagnetic switching valve 10 is connected to a controller C, and the controller C switches the electromagnetic switching valve 10 to a switch position by exciting the solenoid of the electromagnetic switching valve 10 when a signal is input from an operator, and keeps the electromagnetic switching valve 10 at the normal control position by setting the solenoid in a non-excited state unless a signal is input.

The pilot hydraulic pressure source PP discharges a pressure higher than a maximum pilot pressure generated by the throttle 8. Accordingly, when the electromagnetic switching valve 10 is switched to the switch position, the discharge amount of the first main pump MP1 is further reduced, thereby being able to prepare for, for example, power generation in a non-operational state in which it is desirable to reduce loss or the like.

On the other hand, the second main pump MP2 is connected to the second circuit system. To the second circuit system are connected an operation valve 12 for controlling a right travel motor, an operation valve 13 for controlling a bucket cylinder, an operation valve 14 for controlling the boom cylinder BC, and an operation valve 15 for arm second speed for controlling the arm cylinder in this order from an upstream side of the second circuit system.

Each respective operation valve 12 to 15 is connected to the second main pump MP2 via a neutral flow path 16. The operation valves 13, 14 are connected to the second main pump MP2 via a parallel passage 17.

A throttle 18 for pilot pressure control is provided downstream of the operation valve 15 in the neutral flow path 16. The throttle 18 functions in just the same manner as the throttle 8 of the first circuit system.

A pilot flow path 19 is connected between the most downstream operation valve 15 and the throttle 18 in the neutral flow path 16. The pilot flow path 19 is connected to a regulator 21 for controlling a tilting angle of the second main pump MP2 via an electromagnetic switching valve 20.

The electromagnetic switching valve 20 is connected to the pilot hydraulic pressure source PP. When the electromagnetic switching valve 20 is at a normal control position which is a shown normal position, the regulator 21 communicates with the pilot flow path 19. When the electromagnetic switching valve 20 is switched to a switch position by exciting a solenoid thereof, the regulator 21 communicates with the pilot hydraulic pressure source PP. The solenoid of the electromagnetic switching valve 20 is connected to the controller C, and the controller C switches the electromagnetic switching valve 20 to the switch position by exciting the solenoid of the electromagnetic switching valve 20 when a signal is input from the operator, and keeps the electromagnetic switching valve 20 at the normal control position by setting the solenoid in a non-excited state unless a signal is input.

The regulator 21 controls the tilting angle of the second main pump MP2 in inverse proportion to a pilot pressure in the pilot flow path 19 to control a displacement amount per rotation of the second main pump MP2. If there is no more flow in the neutral flow path 16 and the pilot pressure is zeroed by setting the operation valves 12 to 15 in the full-stroke state, the tilting angle of the second main pump MP2 is maximized to maximize the displacement amount per rotation of the second main pump MP2.

One actuator port of the operation valve 14 that controls the boom cylinder BC communicates with a piston-side chamber 23 via one passage 22. A regeneration flow control valve 24 is provided at an intermediate position of the communicating passage 22. The regeneration flow control valve 24 includes a pilot chamber 24*a* on one side thereof and a spring 24*b* on a side thereof facing the pilot chamber 24*a*.

The regeneration flow control valve 24 is kept at a shown normal position by a spring force of the spring 24*b*, but is switched to a switch position on the right side in FIG. 1 when a pilot pressure acts on the pilot chamber 24*a*.

When the regeneration flow control valve 24 is at the shown normal position, a main flow path 24*c* for allowing communication between the one actuator port of the operation valve 14 and the piston-side chamber 23 is fully opened and a regeneration flow path 24*d* for allowing communication between the piston-side chamber 23 and a regenerative hydraulic motor M is closed.

A passage 25 is a passage which allows communication between the regeneration flow path 24*d* and the regenerative hydraulic motor M, and a check valve 26 for permitting only the flow from the regeneration flow path 24*d* to the regenerative hydraulic motor M is provided at an intermediate position of the passage 25.

Another actuator port of the operation valve 14 that controls the boom cylinder BC communicates with a rod-side chamber 28 of the boom cylinder BC via another passage 27. Further, the other passage 27 and the piston-side chamber 23 are connected via a recovery flow path 29, and a recovery flow control valve 30 is provided in the recovery flow path 29. The recovery flow control valve 30 includes a pilot chamber 30*a* on one side thereof and a spring 30*b* on a side thereof facing the pilot chamber 30*a*.

The recovery flow control valve 30 is kept at a shown normal position by a spring force of the spring 30*b*, closes a recovery flow path 30*c* at the normal position, on the other hand, is switched to a switch position on the right side in FIG. 1 and maintains the recovery flow path 30*c* at a throttle opening corresponding to a switched amount when a pilot pressure acts on the pilot chamber 30*a*.

A check valve 31 is provided in the recovery flow path 29 and permits only the flow from the piston-side chamber 23 to the other passage 27.

The respective pilot chambers 24*a*, 30*a* of the regeneration flow control valve 24 and the recovery flow control valve 30 are connected to the pilot hydraulic pressure source PP via a proportional electromagnetic valve 32. The proportional electromagnetic valve 32 includes a solenoid 32*a* connected to the controller C on one side thereof and a spring 32*b* on a side opposite to the solenoid 32*a*.

The proportional electromagnetic valve 32 is kept at a shown normal position by a spring force of the spring 32*b*. When the controller C excites the solenoid 32*a* in accordance with an input signal from the operator, the proportional electromagnetic valve 32 is switched and the opening is controlled according to an excitation current.

Accordingly, pilot pressures acting on the pilot chambers 24*a*, 30*a* of the regeneration flow control valve 24 and the recovery flow control valve 30 can be controlled by the controller C.

However, the spring force of the spring 30*b* of the recovery flow control valve 30 is set to be larger than that of the spring 24*b* of the regeneration flow control valve 24, so that the recovery flow control valve 30 is set to be opened at a later timing even if the same pilot pressure acts.

On the other hand, passages 33, 34 communicating with a rotation motor RM are connected to actuator ports of the operation valve 1 for rotation motor connected to the first circuit system, and brake valves 35, 36 are connected to each of the both passages 33, 34. When the operation valve 1 for rotation motor is kept at the neutral position, the actuator ports are closed and the rotation motor RM is maintained in a stopped state.

When the operation valve 1 for rotation motor is switched in an either direction in the above state, one passage 33 is connected to the first main pump MP1 and the other passage 34 communicates with the tank T. Accordingly, pressure oil is supplied from the passage 33 to rotate the rotation motor RM and return oil from the rotation motor RM is returned to the tank via the passage 34.

When the operation valve 1 for rotation motor is switched in a direction opposite to the above, pump-discharged oil is supplied to the passage 34, the passage 33 communicates with the tank and the rotation motor RM rotates in a reverse direction this time.

When the rotation motor RM is driven, the brake valve 35 or 36 fulfills a function of a relief valve. When the pressures in the passages 33, 34 become equal to or higher than a set pressure, the brake valves 35, 36 are opened to keep the pressures in the passages 33, 34 at the set pressure. Further, if the operation valve 1 for rotation motor is returned to the neutral position in a state where the rotation motor RM is rotating, the actuator ports of this operation valve 1 are closed. Even if the actuator ports of the operation valve 1 are closed, the rotation motor RM continues to rotate due to its inertial energy. In this way, the rotation motor RM is rotated by the inertial energy, thereby acting as a pump. In this case, a closed circuit is formed by the passages 33, 34, the rotation motor RM and the brake valve 35 or 36 and the inertial energy is converted into thermal energy by the brake valve 35 or 36.

The passages 33, 34 communicate with the passage 25 connected to the regenerative hydraulic motor M via check valves 37, 38 and a passage 39. An electromagnetic on-off valve 40 which is controlled to be opened and closed by the controller C is provided in the passage 39, and a pressure sensor 41 for detecting a pressure at the time of rotating the rotation motor RM and a pressure at the time of braking is provided between the electromagnetic on-off valve 40 and the check valves 37, 38. A pressure signal of the pressure sensor 41 is input to the controller C.

A safety valve 42 is provided at a position downstream of the electromagnetic on-off valve 40 in a direction toward the regenerative hydraulic motor M. The safety valve 42 maintains the pressures in the passages 33, 34 to prevent so-called runaway of the rotation motor RM in the event of a failure in a system including the passage 39.

On the other hand, an engine E which drives the first and second main pumps MP1, MP2 transmits a rotational force to a motor generator GM via a transmission mechanism 43 and a clutch 44. Further, an assist pump AP and the regenerative hydraulic motor M are linked to a rotary shaft 45 of the motor generator GM. In this way, the motor generator GM, the assist pump AP and the regenerative hydraulic motor M are linked and respectively integrally rotate.

The assist pump AP and the regenerative hydraulic motor M are a variable-displacement pump and a variable-displacement hydraulic motor and regulators 46, 47 for controlling tilting angles are connected to the controller C.

The motor generator GM rotates upon receiving the rotational force of the engine E or the regenerative hydraulic motor M to fulfill a power generation function, and power generated by the motor generator GM is charged into a battery 49 via an inverter 48. The battery 49 is connected to the controller C and the charged amount of the battery 49 can be grasped by the controller C.

Further, the assist pump AP communicates with the first main pump MP1 via an electromagnetic on-off control valve 50 and communicates with the second main pump MP2 via an electromagnetic on-off control valve 51. The electromagnetic on-off valves 50, 51 include solenoids 50*a*, 51*a* connected to the controller C on one side and springs 50*b*, 51*b* on an opposite side. Accordingly, the electromagnetic on-off control valves 50, 51 are kept at a shown open position by the action of a spring force of the springs 50*b*, 51*b* and switched to a closed position when the solenoids 50*a* 51*a* are excited in response to an output signal from the controller C.

The controller C detects pilot pressures introduced to the regulators 11, 21 for the first and second main pumps MP1, MP2 by pressure sensors 52, 53 and determines whether or not the pressures have reached a maximum pressure set in advance.

If the operator engages the clutch 44 in a non-operational state where the pressures detected by the pressure sensors 52, 53 have reached the maximum pressure set in advance, the controller C determines that the operator wants to charge the battery 49. This is because the operation valves 1 to 5 and 12 to 15 are kept at the neutral position when the pilot pressures introduced to the regulators 11, 21 reach the maximum pressure.

If the operator engages the clutch 44 in a state where the pilot pressures have reached the maximum pressure as described above, the controller C controls the tilting angles of the first and second main pumps MP1, MP2 to minimize their discharge amounts by exciting the solenoids of the electromagnetic switching valves 10, 20 and connecting the regulators 11, 21 to the pilot hydraulic pressure source PP. Simultaneously with this, the tilting angles of the assist pump AP and the regenerative hydraulic motor M are also minimized. By this series of controls, a rotational load of the motor generator GM can be kept at a minimum level.

Since the rotational load of the motor generator GM is kept at the minimum level, a load of the engine E for power generation can be less. Power generated by the motor generator GM is charged into the battery 49 via the inverter 48.

Further, if the operator requests assistance and hydraulic regeneration while actuating an actuator, the clutch 44 is disengaged and its request signal is input to the controller C. The controller C determines whether or not the boom cylinder BC is raised or lowered according to an operating direction of an operation lever that operates the boom cylinder BC. In the case of lowering the boom cylinder BC, the controller C controls the excitation current of the solenoid 32*a* of the proportional electromagnetic valve 32 according to the operating amount of the operation lever, i.e. a lowering speed of the boom cylinder BC intended by the operator. The opening of the proportional electromagnetic valve 32 increases as the lowering speed intended by the operator increases.

When the proportional electromagnetic valve 32 is opened, the pilot pressure from the pilot hydraulic pressure source PP is introduced to the pilot chamber 24*a* of the regeneration flow control valve 24 and the pilot chamber 30*a* of the recovery flow control valve 30.

However, since the spring force of the spring 24*b* of the regeneration flow control valve 24 is lower than that of the spring 30*b* of the recovery flow control valve 30, the regeneration flow control valve 24 is switched to the switch position earlier. The regeneration flow control valve 24 is switched by an amount proportional to the pilot pressure.

If the regeneration flow control valve 24 is switched to the switch position, the return oil from the piston-side chamber 23 of the boom cylinder BC is distributed into the flow returning to the one passage 24 and the flow to be supplied to the regenerative hydraulic motor M according to the switched amount of the regeneration flow control valve 24.

The controller C controls the load of the regenerative hydraulic motor M by controlling the tilting angle of the regenerative hydraulic motor M to maintain the aimed lowering speed of the boom cylinder BC.

If the lowering speed intended by the operator increases, the opening of the proportional electromagnetic valve 32 also increases, wherefore the pilot pressure acting on the pilot chambers 24*a*, 30*a* also increases. If the pilot pressure increases, the recovery flow control valve 30 is switched to the switch position and the recovery flow path 30*c* is opened in proportion to this pilot pressure.

If the recovery flow path 30*c* is opened, a part of return oil from the piston-side chamber 23 of the boom cylinder BC is supplied to the rod-side chamber 28 of the boom cylinder BC via the recovery path 29 and the other passage 27.

If the regenerative hydraulic motor M is rotated utilizing the return oil from the boom cylinder BC with the clutch disengaged in this way, the motor generator GM can be rotated to generate power.

On the other hand, in the case of rotating the rotation motor RM by switching the operation valve 1 for rotation motor in one direction to drive the rotation motor RM connected to the first circuit system, a rotational pressure is kept at a pressure set by the brake valve 35. Further, if the operation valve 1 is switched in a direction opposite to the above, the rotational pressure is kept at a pressure set by the brake valve 36.

Further, if the operation valve 1 for rotation motor is switched to the neutral position while the rotation motor RM is rotating, a closed circuit is formed between the passages 33, 34 and the brake valve 35 or 36 maintains a brake pressure of this closed circuit to convert inertial energy to thermal energy.

Unless the pressure in the passage 33 or 34 is kept at a pressure necessary for a rotating operation or a braking operation, it is not possible to rotate the rotation motor RM or apply braking.

Accordingly, to keep the pressure in the passage 33 or 34 at the rotational pressure or the brake pressure, the controller C controls the load of the rotation motor RM while controlling the tilting angle of the regenerative hydraulic motor M. That is, the controller C controls the tilting angle of the regenerative hydraulic motor M so that the pressure detected by the pressure sensor 41 is substantially equal to the rotational pressure of the rotation motor RM or the braking pressure.

If the regenerative hydraulic motor M obtains a rotational force, this rotational force acts on the motor generator GM that coaxially rotates and the motor generator GM can be rotated by the rotational force of the regenerative hydraulic motor M.

If the regenerative hydraulic motor M is rotated utilizing energy of the rotation motor RM with the clutch 44 disengaged in this way, power can be generated by rotating the motor generator GM.

Further, if the operator inputs a signal requesting assistance of the assist pump AP to the controller C with the clutch 44 disengaged at the time of an operation in which each operation valve 1 to 5, 12 to 15 operate, the controller C controls the tilting angle of the assist pump AP by controlling the regulator 47 for the assist pump AP and keeps the electromagnetic on-off control valves 50, 51 at the open position by setting the solenoids 50*a*, 51*a* in the non-excited state. In this way, the discharged oil from the assist pump AP joins the first and second main pumps MP1, MP2 via the electromagnetic on-off control valves 50, 51. Check valves 54, 55 permit only the joining flow from the assist pump AP to the first and second main pumps MP1, MP2.

In this embodiment, it is naturally good to use the rotational force of the regenerative hydraulic motor M to assist the motor generator GM.

According to this embodiment, it is possible to rotate the motor generator GM using the output of the engine E or rotate the motor generator GM by the rotation force of the regenerative hydraulic motor M only by using one clutch 44.

It is also possible to assist the rotational force of the assist pump AP by the rotational force of the regenerative hydraulic motor M. The pressure flowing into the regenerative hydraulic motor M may be lower than the discharge pressures of the first and second main pumps MP1, MP2. However, in this embodiment, a boosting function is fulfilled by the regenerative hydraulic motor M and the assist pump AP to cause the assist pump AP to maintain a high discharge pressure even if the pressure is low.

That is, an output of the regenerative hydraulic motor M is determined by a product of a displacement volume Q1 per rotation and a pressure P1 at that time. Further, an output of the assist pump AP is determined by a product of a displacement volume Q2 per rotation and a discharge pressure P2. Since the regenerative hydraulic motor M and the assist pump AP coaxially rotate in this embodiment, $Q1 \times P1 = Q2 \times P2$ holds. For example, if the displacement volume Q1 of the regenerative hydraulic motor M is set to be three times as much as the displacement volume Q2 of the assist pump AP, i.e. $Q1 = 3Q2$, the above equation is $3Q2 \times P1 = Q2 \times P2$. If the both sides of this equation are divided by Q2, $3P1 = P2$ holds.

Accordingly, if the displacement volume Q2 is controlled by changing the tilting angle of the assist pump AP, the assist pump AP can be maintained at a predetermined discharge pressure by the output of the regenerative hydraulic motor M. In other words, oil can be discharged from the assist pump AP after boosting the hydraulic pressure from the boom cylinder BC.

A second embodiment is described.

Figure 2:
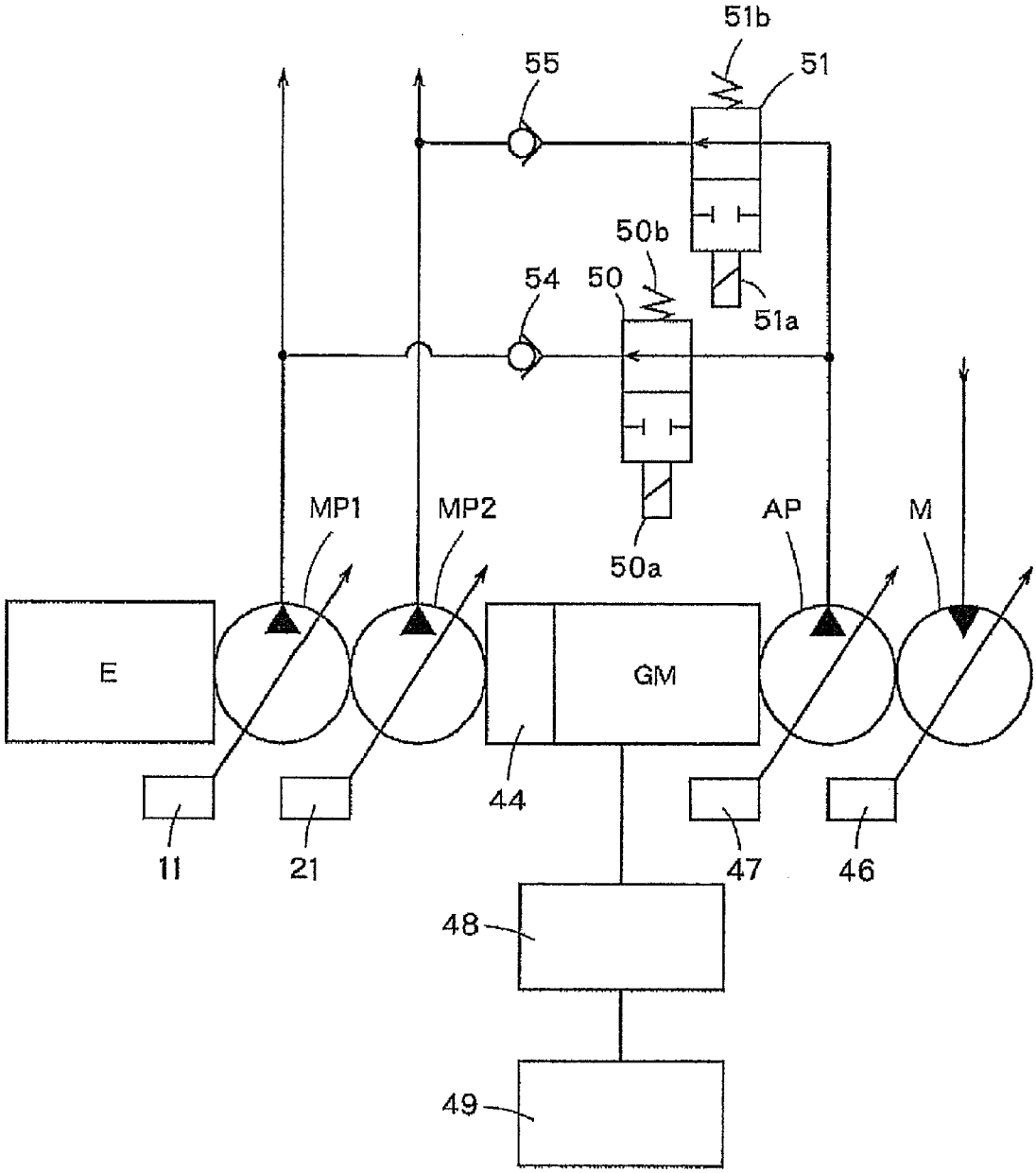
FIG. 2 is a circuit diagram of a control system for hybrid construction machine according to a second embodiment of the present invention.

In the second embodiment show in FIG. 2, the engine E, the first and second main pumps MP1, MP2, the clutch 44 and the motor generator GM, the assist pump AP and the regenerative hydraulic motor M are all linked on the same axis and the transmission mechanism 43 of the first embodiment can be omitted. Configurations other than this are the same as in the first embodiment.

A third embodiment is described.

Figure 3:
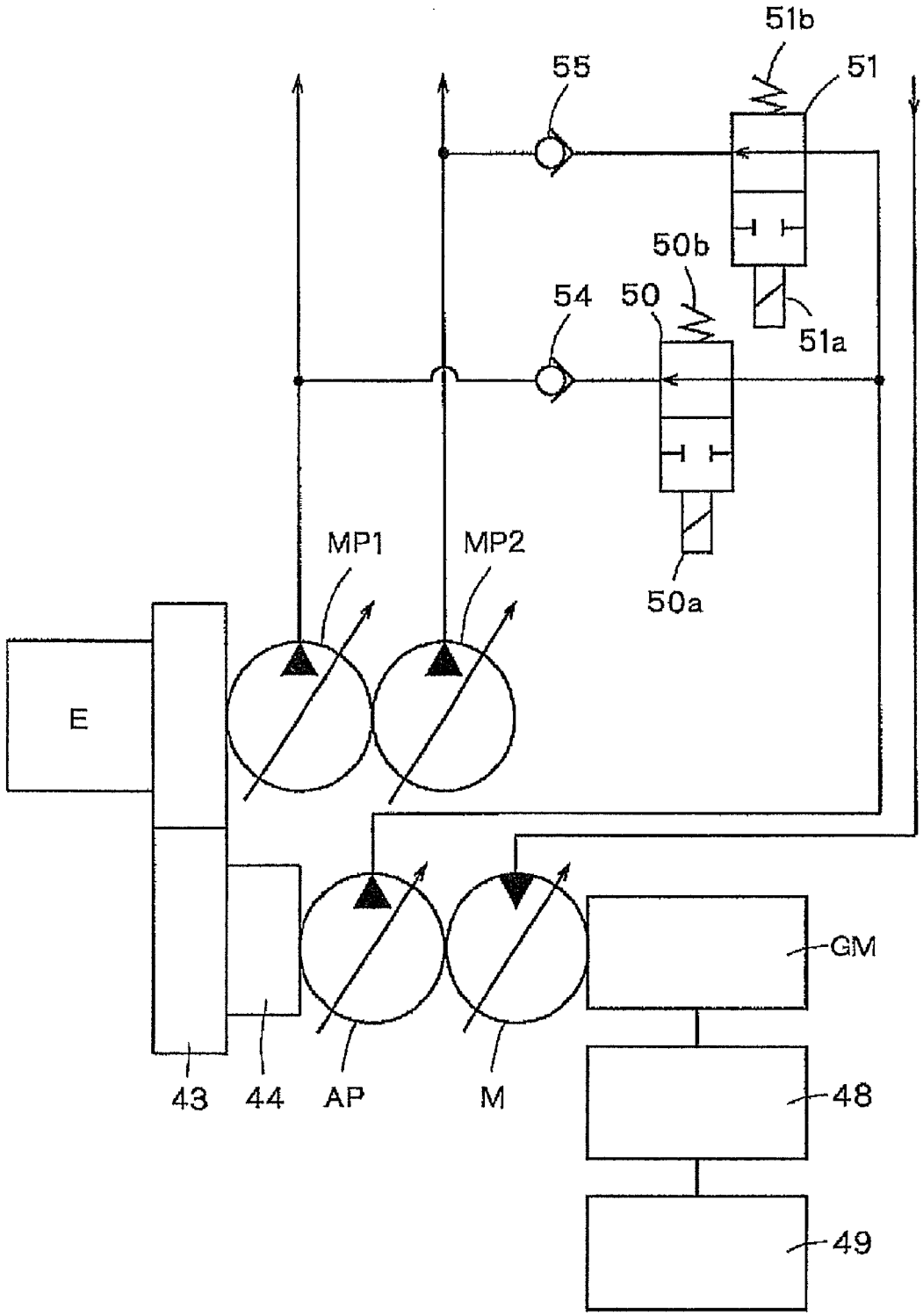
FIG. 3 is a circuit diagram of a control system for hybrid construction machine according to a third embodiment of the present invention.

In the third embodiment shown in FIG. 3, the arrangement of the assist pump AP, the regenerative hydraulic motor M and the motor generator GM is different from that in the first embodiment. Configurations other than this are the same as in the first embodiment.

A fourth embodiment is described.

Figure 4:
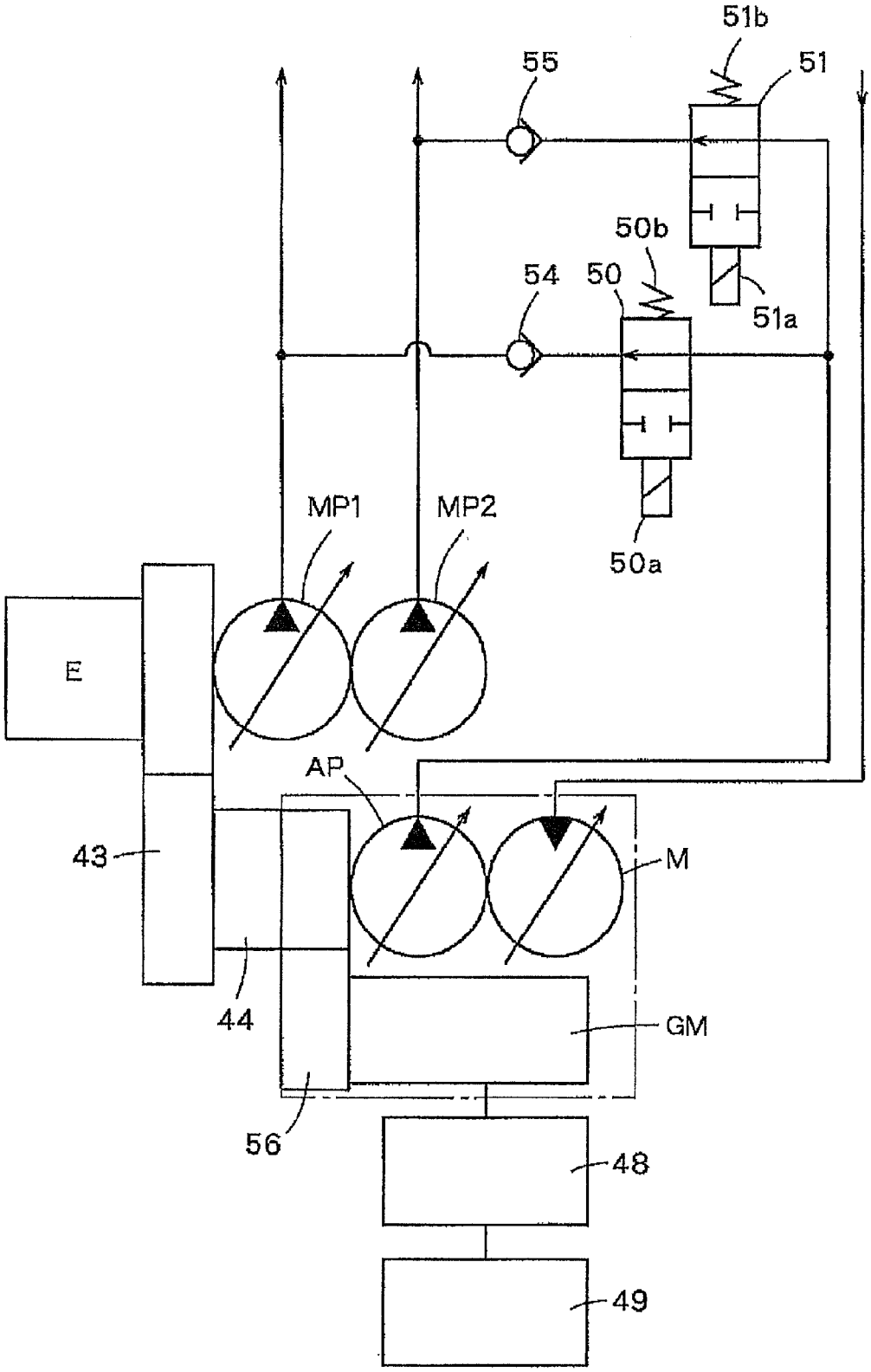
FIG. 4 is a circuit diagram of a control system for hybrid construction machine according to a fourth embodiment of the present invention.

The fourth embodiment shown in FIG. 4 differs from the third embodiment in that the assist pump AP, the regenerative hydraulic motor M and the motor generator GM are connected by a power transmission mechanism 56 such as gears. By connecting the power transmission mechanism 56 to the engine E via the clutch 44, a dimension from the clutch to the hydraulic regeneration and assist units in a longitudinal direction is made shorter to improve ease of mounting of a machine body.

Although the embodiments of the present invention have been described above, the above embodiments are merely illustration of some application examples of the present invention and not of the nature to limit the technical scope of the present invention to the specific constructions of the above embodiments.

The present application claims a priority based on Japanese Patent Application No. 2010-72561 filed with the Japan Patent Office on Mar. 26, 2010, all the contents of which are hereby incorporated by reference.

INDUSTRIAL APPLICABILITY

The present invention can be used for hybrid construction machines such as power shovels.

The invention claimed is:

1. A control system for hybrid construction machine, comprising:

an engine;

a main pump to be driven by the engine;

a rotary shaft coupled to an assist pump, a regenerative hydraulic motor and a motor generator; and a clutch for linking the engine and the rotary shaft, wherein a hydraulic pressure from an actuator is regenerated in the regenerative hydraulic motor by disengaging the clutch and allowing a hydraulic pressure from the assist pump driven by the motor generator to join at a discharge side of the main pump when an operation by the main pump driven by the engine is performed.

2. The control system according to claim 1, further comprising:

a regulator for controlling tilting angles of the assist pump that is a variable-displacement pump and the regenerative hydraulic motor that is a variable-displacement hydraulic motor;

a controller for controlling the regulator;

a regulator for controlling a tilting angle of the main pump that is a variable-displacement pump according to a pilot pressure;

a plurality of operation valves connected to the main pump;

a pilot pressure generation mechanism for keeping the pilot pressure at a maximum pressure when the operation valves are at a neutral position;

a pilot hydraulic pressure source different from the pilot pressure generation mechanism;

an electromagnetic switching valve provided in a path connecting the pilot pressure generation mechanism and the pilot hydraulic pressure source and the regulator for the main pump and adapted to allow the regulator for the main pump to communicate with the pilot pressure generation mechanism or the pilot hydraulic pressure source according to a switch position; and a pressure sensor for detecting a pilot pressure generated in the pilot pressure generation mechanism and transmitting the detected pressure to the controller;

wherein the controller keeps the tilting angle of the main pump at a minimum level by switching the electromagnetic switching valve and introducing a pilot pressure generated in the pilot hydraulic pressure source to the regulator for the main pump, and keeps the tilting angles of the assist pump and the regenerative hydraulic motor at a minimum level by controlling the regulators for the assist pump and the regenerative hydraulic motor when a pilot pressure generated in the pilot pressure generation mechanism reaches the maximum pressure.

3. A control system for hybrid construction machine, comprising:

an engine;

a main pump to be driven by the engine;

a rotary shaft coupled to an assist pump, a regenerative hydraulic motor and a motor generator; and a clutch for linking the engine and the rotary shaft, wherein the motor generator is driven by an output of the engine to store power in a battery by minimizing the discharge amount of the main pump, keeping tilting angles of the assist pump and the regenerative hydraulic motor at a minimum level and engaging the clutch when an operation by the main pump driven by the engine is not performed.

4. The control system according to claim 3, further comprising:

a regulator for controlling tilting angles of the assist pump that is a variable-displacement pump and the regenerative hydraulic motor that is a variable-displacement hydraulic motor;

a controller for controlling the regulator;

a regulator for controlling a tilting angle of the main pump that is a variable-displacement pump according to a pilot pressure;

a plurality of operation valves connected to the main pump;

a pilot pressure generation mechanism for keeping the pilot pressure at a maximum pressure when the operation valves are at a neutral position;

a pilot hydraulic pressure source different from the pilot pressure generation mechanism;

an electromagnetic switching valve provided in a path connecting the pilot pressure generation mechanism and the pilot hydraulic pressure source and the regulator for the main pump and adapted to allow the regulator for the main pump to communicate with the pilot pressure generation mechanism or the pilot hydraulic pressure source according to a switch position; and a pressure sensor for detecting a pilot pressure generated in the pilot pressure generation mechanism and transmitting the detected pressure to the controller;

wherein the controller keeps the tilting angle of the main pump at a minimum level by switching the electromagnetic switching valve and introducing a pilot pressure generated in the pilot hydraulic pressure source to the regulator for the main pump, and keeps the tilting angles of the assist pump and the regenerative hydraulic motor at a minimum level by controlling the regulators for the assist pump and the regenerative hydraulic motor when a pilot pressure generated in the pilot pressure generation mechanism reaches the maximum pressure.

* * * * *